United States Patent [19]

Tsuchiya et al.

[11] 4,375,328

[45] Mar. 1, 1983

[54] ELECTROPHOTOGRAPHIC DEVICE WITH LIGHT QUANTITY CONTROL

[75] Inventors: Hiroaki Tsuchiya, Tokyo; Yasuhide Kurosaki, Mitaka, both of Japan

[73] Assignee: Canon Kabushiki Kaisha, Tokyo, Japan

[21] Appl. No.: 148,215

[22] Filed: May 9, 1980

[30] Foreign Application Priority Data

May 17, 1979 [JP] Japan ..... 54-60785

[51] Int. Cl.[3] ..... G03G 15/04

[52] U.S. Cl. ..... 355/14 E

[58] Field of Search ..... 355/14 R, 14 E, 69; 430/902

[56] References Cited

U.S. PATENT DOCUMENTS

| | | | |
|---|---|---|---|
| 3,738,242 | 6/1973 | Lee et al. | 355/69 X |
| 3,749,488 | 7/1973 | DeLorme | 355/69 X |
| 4,105,324 | 8/1978 | Seil | 355/14 E |
| 4,136,945 | 1/1979 | Stephens | 355/14 E |

FOREIGN PATENT DOCUMENTS

| | | | |
|---|---|---|---|
| 2913761 | 10/1979 | Fed. Rep. of Germany . | |
| 1573127 | 8/1980 | United Kingdom | 355/14 E |

*Primary Examiner*—G. Z. Rubinson
*Assistant Examiner*—Keith E. George
*Attorney, Agent, or Firm*—Fitzpatrick, Cella, Harper & Scinto

[57] ABSTRACT

An electrophotographic device constructed with a light irradiating device to irradiate light on a photosensitive member, a charging device to uniformly charge the photosensitive member after the light irradiation by the light irradiating device; a light image projecting device to project a light image after the charging by the charging device to thereby form an electrostatic latent image corresponding to the light image on the photosensitive member, a developing device to develop the electrostatic latent image, and a control device to vary the irradiated light quantity by the light irradiating device and the exposure light quantity by the light image projecting device in accordance with a potential state of the photosensitive member at the time of the latent image formation.

22 Claims, 8 Drawing Figures

ELECTROPHOTOGRAPHIC DEVICE WITH LIGHT QUANTITY CONTROL

BACKGROUND OF THE INVENTION

1. Field of the Invention

This invention relates to an electrophotographic device which forms an electrostatic latent image by way of electric charging and exposure steps. More particularly, it is concerned with an electrophotographic device which is capable of stabilizing the potential of the electrostatic latent image to produce a stable image.

2. Description of Prior Arts

Generally speaking, an electrostatic latent image can be formed by (1) a method of uniformly charging a photosensitive member constructed with a photoconductive layer coated on an electrically conductive substrate by a corona discharge followed by irradiation of a light image (the so-called "Carlson Process"); or (2) a method of charging a photosensitive member constructed with a photoconductive layer formed on an electrically conductive base and an insulative layer further provided on the photoconductive layer with a corona discharger as disclosed in U.S. Pat. No. 4,071,361 or 3,666,363, then removing the charge by a corona discharge in a polarity opposite to that of the abovementioned corona discharge or an a.c. corona discharge substantially simultaneously with the light image irradiation, and finally uniformly irradiating light over the entire surface of the photosensitive member.

In either method, however, the photoconductive substance to be used has a phenomenon called "photohysteresis". On account of this phenomenon, when the photosensitive member is repeatedly used, there occurs a difference in the latent image potential between a portion where light was irradiated previously and a portion where no light was irradiated, this potential difference emerging as the so-called "ghost" in the image after its development. In order to solve this problem, there has generally been adopted a method, wherein the photosensitive member is subjected to uniform light irradiation over its entire surface prior to entering into the charging process after the latent image has been developed, thereby eliminating the abovementioned ghosting phenomenon. Further, the photoconductive substance has such a phenomenon that, according as it is composed generally of a higher and higher resistance material, the smoothness in the image quality on the solid black portion becomes lowered (the so-called "coarseness"). The abovementioned light irradiation prior to the abovementioned charging is effective for solving this problem. This uniform light irradiation over the entire surface of the photosensitive member will hereinafter be called "pre-exposure". It has already been experimentally verified that the light quantity for the pre-exposure for solving the abovementioned ghost and coarseness phenomena may be at a predetermined quantity or above. Also, when the latent image formation is continuously done, the photosensitive member, due to its own characteristic, increases the latent image potential with lapse of time (the rising characteristic) or decreases the same with lapse of time (the trailing characteristic), even if the exposure light quantity and the output from the charger are constant. This rising and trailing characteristics give mal-effect to the image quality. For example, when the photosensitive member has the rising characteristic, the density gradually increases and the so-called "fogging" occurs on the white background portion. In the case of the trailing characteristics, the density gradually decreases and the image skips off from place to place.

In order therefore to compensate these rising and trailing characteristics, there has so far been contemplated control of the exposure light quantity, charging quantity, developing bias, and so forth. However, the control of the charging quantity and the developing bias invites complicacy and increase in size of a high tension transformer, which is inconveniently associated with high manufacturing cost and increased size of the electrophotographic device as a whole. Moreover, since variations in quantity of the electric potential at both dark and light portions on the photosensitive member differ depending on the rising or trailing characteristics, such characteristics cannot be corrected perfectly by the control of the charging quantity alone. Also, there is a method of controlling the developing bias voltage as a voltage which is slightly increased to a value of the potential at the light portion, although this cannot be a fundamental solution to variations in the image contrast (a differential voltage between the light portion potential and the dark portion potential). Furthermore, it has been difficult to correct variations in the latent image potential of the photoconductive substance by the control of the image exposure light quantity alone.

Incidentally, sensitivity characteristics of the device, that is the rising and trailing of the potential in the photoconductive substance such as Se, CdS, ZnS, and so on (hereinafter referred to "photosensitive member"), are not uniform. Therefore, the factors causing the variations in the latent image potential are of variety, as follows.

(A) rising and trailing characteristic of the potential at the dark portion (a portion in the photosensitive member where no light is irradiated, i.e., a portion corresponding to black image in an original);

(B) rising and trailing characteristic of the potential at the light portion (a portion in the photosenstive member where light is irradiated, i.e., a portion corresponding to white image in an original);

(C) change in the degree of the preceding sensitivity characteristics (A) and (B) due to stoppage time of the device;

(D) change in the degree of the preceding sensitivity characteristics (A) and (B) due to the potential state prior to stoppage of the device;

(E) change in the degree of the preceding sensitivity characteristics (A) and (B) due to fluctuations in the characteristics at the time of manufacturing the photosensitive member; and others.

It has been difficult to provide the electrophotographic device which is capable of responding to all the afore-described factors for the potential changes in the latent image by the conventional technique.

SUMMARY OF THE INVENTION

In view of the foregoing, it is a general object of the present invention to provide an electrophotographic device capable of compensating the characteristic changes in the photosensitive member and of controlling the latent image potential with high stability.

It is the primary object of the present invention to provide an electrophotographic device capable of compensating the sensitivity changes in the photosensitive member by varying the pre-exposure light quantity and the image exposure light quantity in accordance with variations in the potential state of the photosensitive member during the latent image formation.

It is the secondary object of the present invention to provide an electrophotographic device capable of compensating a difference in the potential state of the photosensitive member prior to the latent image formation by varying the pre-exposure light quantity and the image exposure light quantity in accordance with length of a stoppage time continuing from the previous operation, or the operating time in the previous operation.

The foregoing objects, other objects as well as the detailed construction and operations of the electrophotographic device according to the present invention will become more apparent from the following explanations of a preferred embodiment, when read in conjunction with the accompanying drawing.

DETAILED DESCRIPTION OF PREFERRED EMBODIMENT

In the following, the electrophotographic device according to the present invention will be explained in reference to the accompanying drawing.

Figure 1:
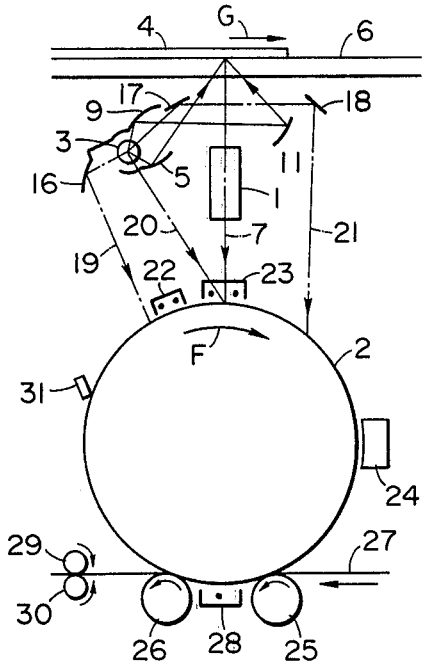
FIG. 1 is a schematic cross-sectional view of a reproduction apparatus, to which the present invention is applicable.

Referring to FIG. 1 showing a schematic cross-sectional view of a part of the electrophotographic device, to which the present invention is applicable, a reference numeral 1 designates a lens using a light converging glass fibers ("Celfoc lens"—a trade name); a numeral 2 refers to a photosensitive member; a numeral 3 a halogen lamp; 4 an image original; 5 a lower reflecting mirror; 6 a glass table for mounting the image original 4 thereon; 7 an image exposure light beam; 9 an upper reflecting mirror; 11, 16, 17 and 18 mirrors; 19 a pre-exposure light beam; 20 a blank exposure light beam; 21 an overall exposure light beam; 22 and 23 corona dischargers; 28 an image transfer charger; and 31 a cleaning blade.

In the drawing, the photosensitive member 2 consists of, from its outer surface side, a transparent insulative layer, a photoconductive layer, and an electrically conductive substrate, and rotates in the direction of an arrow F. After the pre-exposure by the pre-exposure light beam 19 from the lamp 3, the photosensitive member 2 is subjected to uniform charging over the entire surface thereof by the corona discharger 22. Thereafter, the photosensitive member 2 is subjected to irradiation of the image exposure light beam 7 from the image original 4 through the lens 1, and, at the same time, to an a.c. corona discharge or a corona discharge in the polarity opposite to that of the corona discharger 22 (for example, negative (−) polarity) by the corona discharger 23, whereby the light-irradiated portion is removed of its charge and an electrostatic pattern corresponding to an image of the image original 4 is formed on the photosensitive member, since the image mounting table 6 moves in the direction of an arrow G. Furthermore, by the overall exposure light beam 21, the photosensitive member 2 is subjected to a uniform exposure over its entire surface, whereby the electrostatic latent image of a high image contrast is formed thereon. The thus formed latent image is visualized by the image developer 24 as a toner image. The toner image is then transferred onto an image transfer paper 27 by image transfer rollers 25, 26 and the image transfer charger 28. The toner image on the image transfer paper is subjected to image-fixing by image fixing rollers 29, 30, after which it is discharged outside the device. The photosensitive member 2 further rotates, during which residual toner thereon is wiped away by the cleaning blade 31. The electrophotographic device thus repeats the above-described image forming cycle. Incidentally, the blank exposure light beam 20 irradiates the other area than the image area on the photosensitive member 2 to prevent the toner from excessively adhering on it.

As stated in the foregoing, according to the above-described embodiment, the lamp 3 serves for the pre-exposure, the image original exposure, the blank exposure, and the overall exposure.

Figure 2:
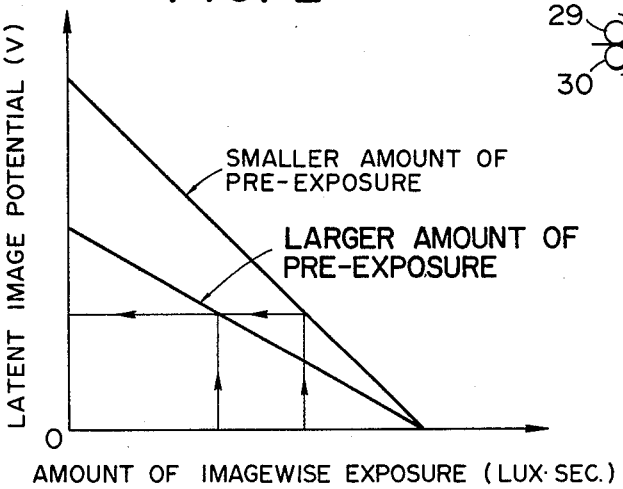
FIG. 2 is a graphical representation showing a relationship between an exposure light quantity and a latent image potential with the pre-exposure light quantity being taken as a parameter.

FIG. 2 shows variations in the latent image potential with respect to variations in the image exposure light quantity to the photosensitive member with the pre-exposure light quantity being taken as a parameter. As will be understood from FIG. 2, when the pre-exposure light quantity increases, the dark portion potential lowers, while variations in the light portion potential are small. Also, when the pre-exposure light quantity is reduced, the change in the light portion potential is small, while the dark portion potential rises. Accordingly, the dark portion potential can be controlled by varying the pre-exposure light quantity.

Figure 3:
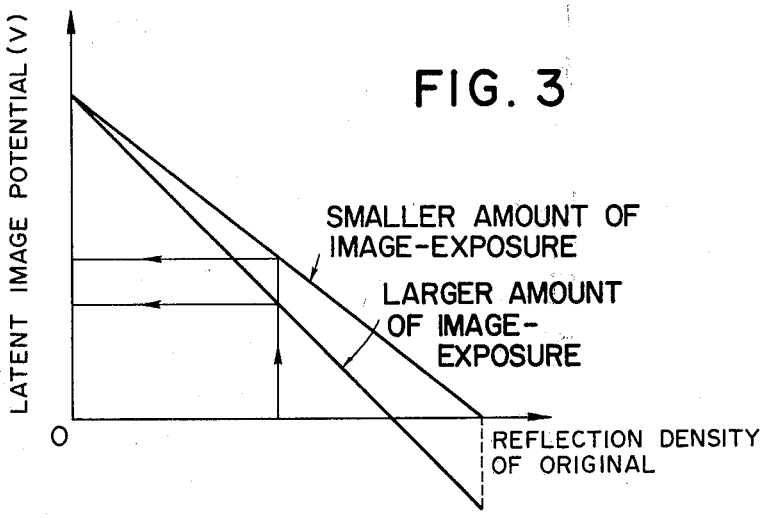
FIG. 3 is also a graphical representation showing a relationship between a reflection density of an image original and a latent image potential with an image exposure light quantity as a parameter.

FIG. 3 shows a relationship between the reflection density of the image original and the latent image potential with the image exposure light quantity as a parameter. As is understandable from the graph in FIG. 2, the change in the dark portion potential is small, even when the image exposure light quantity is varied. However, when the image exposure light quantity is increased, the light portion potential lowers, while, when the image exposure light quantity is decreased, the light portion potential increases. Accordingly, by varying the image exposure light quantity, the light portion potential can be controlled. Incidentally, the image exposure light quantity in FIG. 2 shows a light quantity which is actually irradiated onto the photosensitive member, while the image exposure light quantity as the parameter shown in FIG. 3 shows an element to vary the irradiated light quantity to the photosensitive member relative to the reflection density of the image original such as magnitude of the image original exposure light quantity or magnitude of the light transmission factor by a filter, and so forth. Therefore, the image exposure light quantity in FIG. 3 to be actually irradiated onto the photosensitive member becomes larger in the case of the large image exposure light quantity than in the case of the small image exposure light quantity, even if the reflection density of the image original in both cases is the same.

Based on the above-described relationship, the control is done by combining both pre-exposure light quantity and image exposure light quantity, whereby the changes in the latent image potential can be corrected. In more detail, the abovementioned factor A can be compensated by controlling the pre-exposure light quantity, while the factor B can be compensated by controlling the image exposure light quantity. Further, by detecting the stoppage time of the device by the timer, compensation of the factor C becomes also possible. Furthermore, by detecting the previous copying time using the timer, compensation of the factor D becomes also possible. Moreover, when, for example, a CR time constant circuit is used for the abovementioned timer, compensation of the factor E becomes also possible by varying a capacity of the capacitor or a resistance value for each photosensitive member.

Figure 4:
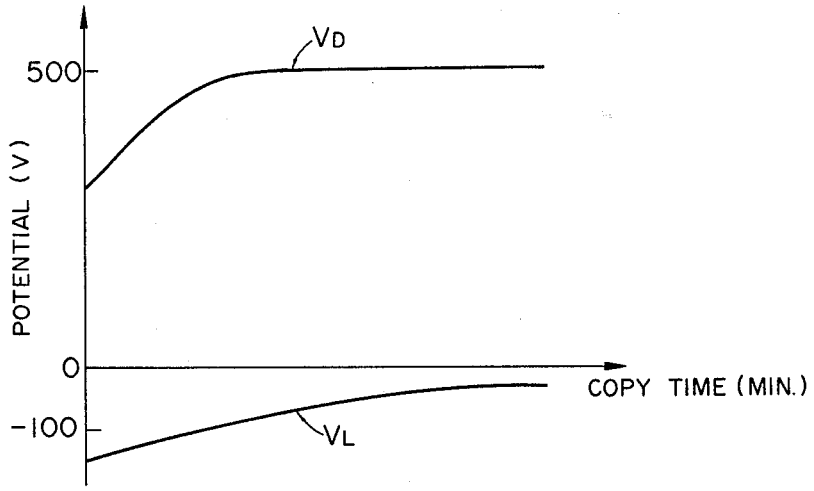
FIG. 4 is a graphical representation showing the characteristic of the photosensitive member.
Figure 5:
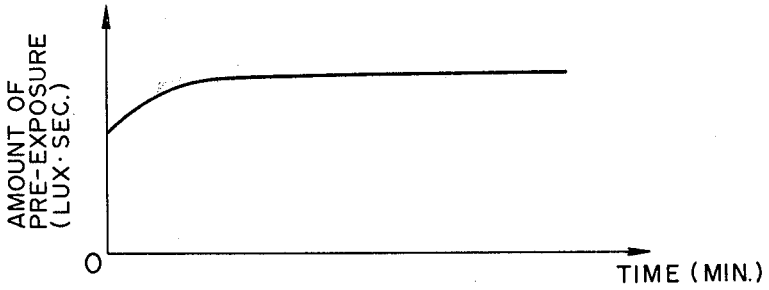
FIGS. 5 and 6 respectively show control waveforms of the pre-exposure light quantity and the image exposure light quantity to compensate the characteristics shown in FIG. 4.
Figure 6:
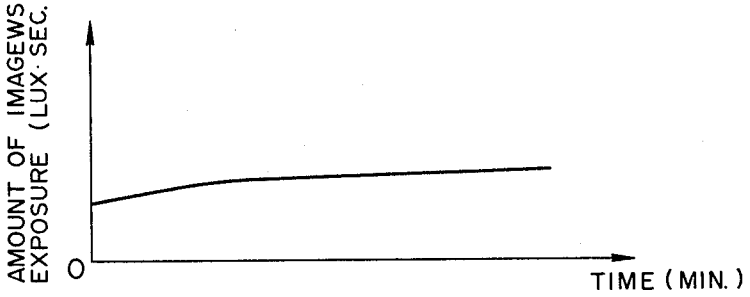

For example, as shown in FIG. 4, when the dark portion potential $V_D$ and the light portion potential $L_L$ change with lapse of the copying time, the pre-exposure light quantity and the image original exposure light quantity may be controlled in the manner as shown in FIGS. 5 and 6.

Figure 7:
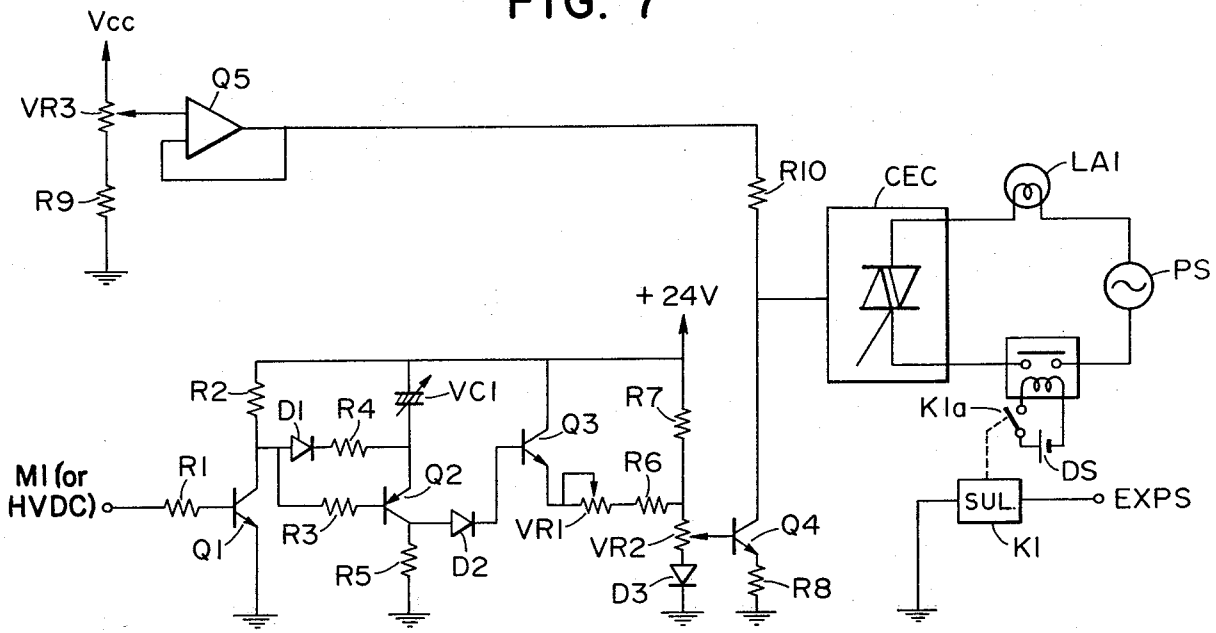
FIG. 7 is a control circuit diagram.
Figure 8:
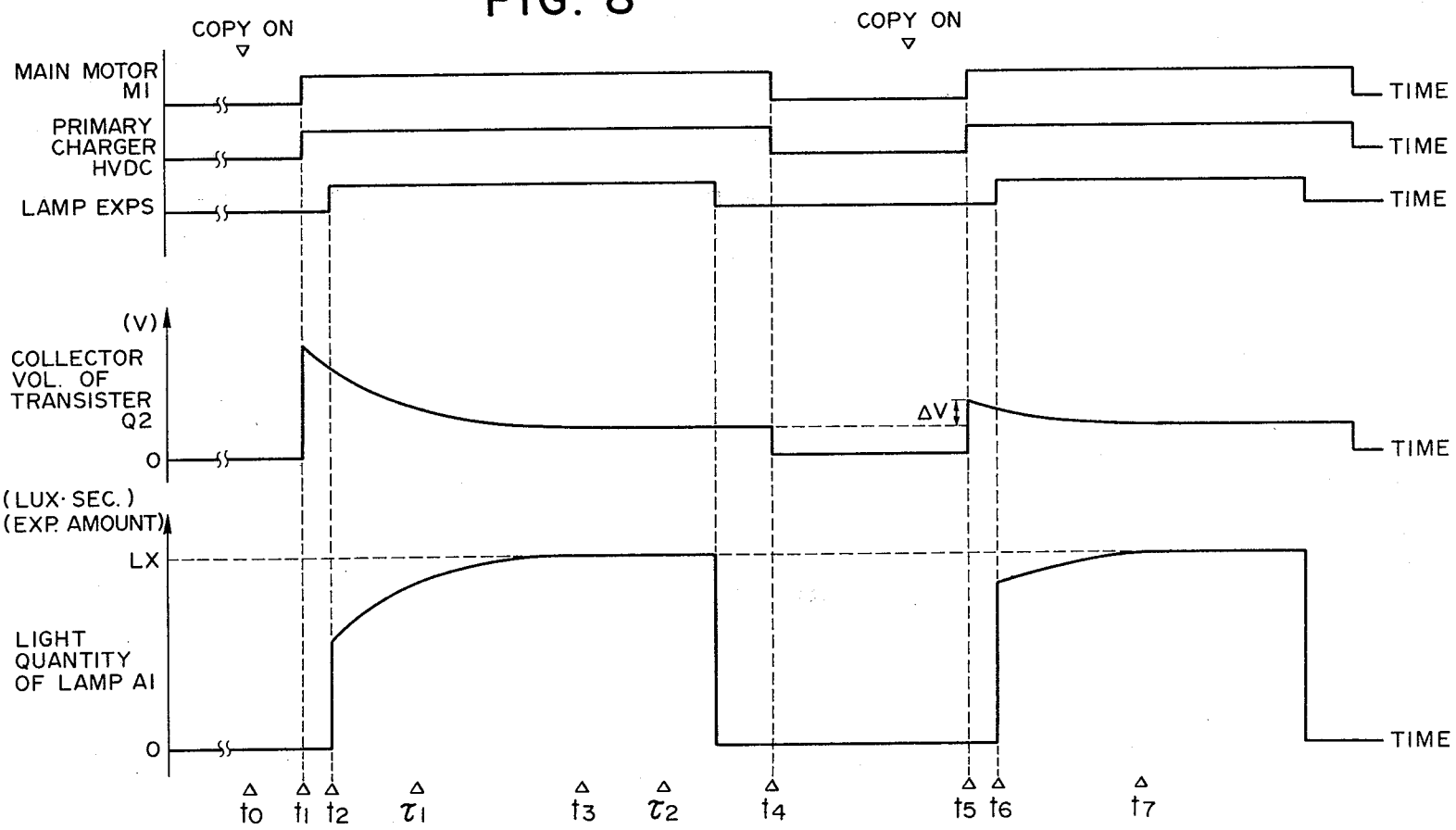
FIG. 8 is an operational time chart.

FIG. 7 shows a concrete circuit for realizing the above-described controls, and FIG. 8 shows the operational timings for the circuit.

In FIG. 7, HVDC refers to a signal for driving the corona discharger 22; $R_1$ to $R_{10}$ designate resistors; $VR_1$ to $VR_3$ denote variable resistors; $Q_1$ to $Q_4$ refer to transistors; $VC_1$ a variable capacitor; $D_1$ to $D_3$ diodes; $LA_1$ a halogen lamps; PS an a.c. power source; DS a d.c. power source; K1 a solenoid; Kla a relay; CEC a light adjusting circuit; M1 (or the identical wave-form HVDC) a main motor drive signal to rotate the photosensitive drum, etc.; and EXPS a lamp lighting signal. The signals M1 (or HVDC) and EXPS are given by a sequence control circuit (not shown). One example of such sequence control circuit is disclosed in U.S. Patent Application Ser. No. 964,985 filed Nov. 30, 1978 by the same assignee-to-be as that of the present application.

The circuit operation of the FIG. 7 embodiment will be described in the following. In case the image formation is not performed over a long period of time and no charging is given to the capacitor $VC_1$, when the copy button is depressed at a time instant $t_0$ and the charger driving signal output HVDC is produced, the transistor $Q_1$ and the transistor $Q_2$ are turned on, whereby the capacitor $VC_1$ is charged through the transistor $Q_2$ and the resistor $R_5$. The charging time $T_1$ can be expressed by the following equation: $T_1=C_1.R_5$ (where: $C_1$ is the capacity of the capacitor $VC_1$). The collector voltage of the transistor $Q_2$ varies from the vicinity of 24 V to the vicinity of 0 volt with respect to the ground simultaneously with commencement of the charging. The collector voltage drives an emitter follower circuit consisting of the transistor $Q_3$ through the protective diode $D_2$. This voltage is divided by the variable resistor $VR_1$ and the resistor $R_5$ to control a voltage applied to the base of the transistor $Q_4$. As the result, it controls an input voltage Vin to the light adjusting circuit CEC to further control the light quantity of the exposure lamp $LA_1$. The concrete construction of the light adjusting circuit is shown in detail in FIG. 10B of U.S. Patent Application Ser. No. 68,416 filed Aug. 21, 1979 by the same assignee-to-be as that of the present application. When the above mentioned time $T_1$ is lapsed, the capacitor $VC_1$ completes its charging, and the collector voltage of the transistor $Q_2$ does not change, hence no change in the exposure light quantity. Subsequently, when the continuous copying terminates, and the abovementioned drive signal HVDC is turned off, the transistor $Q_1$ is turned off, whereby the charge accumulated in the capacitor $VC_1$ is discharged through the diode $D_1$ and the resistors $R_2$, $R_4$. The time constant $T_2$ of this discharge time is determined by the following equation: $T_2=(C_1.(R_2+R_4)$. When the signal HVDC is turned on again before the charge in the capacitor $VC_1$ is completely discharged, the emitter voltage of the transistor $Q_2$ increases by $\Delta V$ due to the residual charge in the capacitor $VC_1$.

Here, $VR_3$ designates the variable resistor for density adjusting, and a voltage divided by this variable resistor $VR_3$ is introduced as an input into the light adjusting circuit CEC through a voltage follower circuit constructed with the operational amplifier $Q_5$ and through the resistor $R_{10}$. The collector current in the transistor $Q_4$ varies depending on the base voltage of the transistor $Q_4$. $VR_2$ designates the variable resistor for adjusting the collector current in the transistor $Q_4$, and $D_3$ refers to the temperature compensating diode.

At the time instant $t_1$ in FIG. 8, the charge in the capacitor $C_1$ is zero. At the time instant $t_2$, the lamp lighting signal EXPS is produced as an output, which reaches a predetermined light quantity LX at the time instant $t_3$. Upon termination of the continuous copying operation, the lamp $LA_1$ and the charger are turned off at the time instant $t_4$. Again, at the time instant $t_5$, when the charger is turned on, the collector voltage increases by $\Delta V$ in accordance with the charging quantity of the capacitor $VC_1$, and the capacitor $VC_1$ starts again the charging operation. The lamp $LA_1$ is again lighted at the time instant $t_6$, and the capacitor $VC_1$ completes its charging at the time instant $t_7$, whereupon the light quantity reaches a predetermined value LX and does not change until the copying operation terminates. In other words, the light quantity is able to follow the sensitivity variation of the photosensitive member during the latent image formation.

Here, as will be clear from comparison of the light quantities at the time instants $t_2$ and $t_6$, the initial value of the exposure light quantity differs depending on the stoppage time of the exposure lamp. In more detail, when the stoppage time is long, a large difference occurs between the initial value of the exposure light quantity and a predetermined light quantity LX, and, when the stoppage time is short, a difference between the initial value of the exposure light quantity and the predetermined light quantity LX is small. Also, as will be apparent from comparison between the time instant $t_2$-$t_3$ and the time instant $t_6$-$t_7$, when the stoppage time of the device is long, the time until the exposure light quantity reaches its predetermined value is long, while, when the stoppage time is short, the time until the exposure light quantity reaches its predetermined value LX is short.

Also, when the copying time is short and the variable capacitor $VC_1$ is not completely saturated (e.g., when the copying operation terminates at the time instant $\tau_1$ in FIG. 8), electric charge remains in the capacitor $VC_1$, and the charging starts with commencement of the stoppage time. Accordingly, even when the stoppage time is constant due to the circuit in FIG. 7, the exposure light quantity can be varied by the length of the previous copying time, i.e., the potential state of the photosensitive member prior to the latent image formation.

Furthermore, where there are fluctuations in the characteristics of the photosensitive member, the fluctuation can also be compensated by changing the above-mentioned time constants $T_1$, $T_2$ based on the variations in the capacity of the variable capacitor $VC_1$.

Incidentally, while it is possible to control the light quantity of the pre-exposure and the image exposure by the light adjusting circuit, such light quantity can also be controlled by regulating the size of the slit, or by moving the optical filter which continuously changes its light transmission factor.

As stated in the foregoing, the present invention is capable of compensating the rising and trailing characteristics of the photosensitive member with respect to both dark portion potential and light portion potential, so that a constant and stable electrostatic latent image can always be obtained irrespective of lapse of the copying time, stoppage time of the device, and previous operating time of the device. Moreover, by the use of one and the same light source for the pre-exposure and the image exposure, a single light quantity control circuit well meet the purpose of the invention, whereby the device can be provided at a cheaper cost.

While the present invention has been explained in reference to the electrophotographic device based on the simultaneous exposure and charging process, the embodiment according to the present invention is also applicable to the electrophotographic device based on the Carlson process. Further, in the present embodiment, the light adjustment is done by a single lamp which serves for both image original exposure and the pre-exposure, although it is possible to apply this embodiment to a device having separate lamps for the respective purposes by providing the light adjusting circuit or the aperture control means.

The present invention has wide variety of applications within the spirit and scope of the present invention as recited in the appended claims, not limited to the aforedescribed embodiment alone.

What we claim is:

1. An electrophotographic device, comprising:

(a) light irradiating means to irradiate light on a photosensitive member having certain sensitivity characteristics;

(b) charging means to uniformly charge said photosensitive member after the light irradiation by said light irradiating means;

(c) light image projecting means to project a light image after the charging by said charging means, thereby forming an electrostatic latent image corresponding to said light image on said photosensitive member;

(d) developing means to develop said electrostatic latent image; and (e) control means to vary the irradiated light quantity by said light irradiating means and the exposure light quantity by said light image projecting means with lapse of a lighting time in said light source so that the sensitivity characteristics of said photosensitive medium are compensated for variations in said lapse of lighting time.

2. The electrophotographic device according to claim 1, wherein said control means includes time constant means, an output of which varies with lapse of said lighting time, and said irradiated light quantity and said exposure light quantity are controlled by the output from said time constant means.

3. The electrophotographic device according to claim 2, wherein said control means has a light adjusting circuit to electrically adjust said irradiated light quantity and said exposure light quantity by the output from said time constant means.

4. The electrophotographic device according to claim 2 or 17, wherein said time constant circuit further counts the stoppage time of the device, and adjusts said irradiated light quantity and said exposure light quantity in accordance with lapse of said lighting time and said stoppage time.

5. The electrophotographic device according to claim 4, wherein said time constant circuit is constructed with a charging and discharging circuit of a capacitor.

6. The electrophotographic device according to claim 5, wherein the time constant in said charging and discharging circuit differs in the charging and the discharging.

7. The electrophotographic device according to claim 6, wherein said charging and discharging circuit is charged with lapse of the lighting time and discharged with lapse of the stoppage time.

8. An electrophotographic device, comprising:

(a) light irradiating means to irradiate light on a photosensitive member having certain sensitivity characteristics;

(b) charging means to uniformly charge said photosensitive member after the light irradiation by said light irradiating means;

(c) light image projecting means to project a light image after the charging by said charging means, thereby forming an electrostatic latent image corresponding to said light image on said photosensitive member;

(d) developing means to develop said electrostatic latent image; and (e) light quality control means to vary the irradiated light quantity of said light irradiating means and the exposure light quantity of said light image projecting means in accordance with a length of a stoppage time of said device so that the sensitivity characteristics of said photosensitive medium are compensated for variations in said stoppage times.

9. The electrophotographic device according to claim 8, wherein said light quantity control means has timer means to count said stoppage time, and gradually varies said irradiated light quantity and said exposure light quantity.

10. The electrophotographic device according to claim 9, wherein said light quantity control means further includes a light adjusting circuit to electrically adjust said irradiated light quantity and said exposure light quantity by the output from said timer means.

11. The electrophotographic device according to claim 9 or 10, wherein said timer circuit also counts the operating time of the device, and adjusts said irradiated light quantity and said exposure light quantity in accordance with lapse of said operating time and said stoppage time.

12. The electrophotographic device according to claim 11, wherein said timer circuit is constructed with a charging and discharging circuit of a capacitor.

13. The electrophotographic device according to claim 12, wherein the time constant in said charging and discharging circuit differs in the charging and discharging.

14. The electrophotographic device according to claim 13, wherein said charging and discharging circuit is charged with lapse of the operating time and discharged with lapse of the stoppage time.

15. An electrophotographic device, comprising:

(a) light irradiating means to irradiate light on a photosensitive member having certain sensitivity characteristics;

(b) charging means to uniformly charge said photosensitive member after the light irradiationn by said light irradiating means;

(c) light image projecting means to project a light image after the charging by said charging means, thereby forming an electrostatic latent image corresponding to said light image on said photosensitive member;

(d) developing means to develop said electrostatic latent image; and (e) light quantity control means to vary the irradiated light quantity of said light irradiating means and the exposure light quantity of said light image projecting means in accordance with a length of a previous operating time of said device so that the sensitivity characteristics of said photosensitive medium are compensated for variations in said lengths of time.

16. The electrophotographic device according to claim 15, wherein said light quantity adjusting means determines the initial values of said irradiated light quantity and said exposure light quantity based on said operating time and a stoppage time until said device commences its current operation.

17. The electrophotographic device according to claim 16, wherein said light quantity adjusting means further varies gradually said irradiated light quantity and said exposure light quantity with lapse of the current operating time of said device.

18. The electrophotographic device according to claim 17, wherein said light quantity adjusting means has time constant circuit means which counts both said stoppage time and said operating time.

19. The electrophotographic device according to claim 18, wherein said light quantity control means has a light adjusting circuit to electrically adjust said irradiated light quantity and said exposure light quantity by the output from said time constant means.

20. The electrophotographic device according to claim 19, wherein said time constant circuit is constructed with a charging and discharging circuit of a capacitor.

21. The electrophotographic device according to claim 20, wherein the time constant in said charging and discharging circuit differs in the charging and discharging.

22. The electrophotographic device according to claim 21, wherein said charging and discharging circuit is charged with lapse of a lighting time and discharged with lapse of a stoppage time.

* * * * *